US005826362A

United States Patent [19]

Lyons

[11] Patent Number: 5,826,362

[45] Date of Patent: Oct. 27, 1998

[54] FIREARM WITH SAFETY

[75] Inventor: James D. Lyons, Globe, Ariz.

[73] Assignee: Dunlyon R & D, Inc., Miami, Ariz.

[21] Appl. No.: 897,226

[22] Filed: Jul. 21, 1997

[51] Int. Cl.[6] ..... F41A 17/76

[52] U.S. Cl. ..... 42/70.08; 42/66

[58] Field of Search ..... 42/70.06, 70.05, 42/70.04, 66, 70.08

[56] References Cited

U.S. PATENT DOCUMENTS

| | | | |
|---|---|---|---|
| 2,579,736 | 12/1951 | Gartner | 42/66 |
| 2,856,718 | 10/1958 | Fischer | 42/70.05 |
| 3,120,713 | 2/1964 | Lizza et al. | 42/70.04 |
| 3,482,348 | 12/1969 | Zanchi | 42/66 |
| 3,735,519 | 5/1973 | Fox | 42/70.04 |
| 3,777,384 | 12/1973 | Ruger et al. | 42/66 |
| 4,173,964 | 11/1979 | Curran | 124/40 |
| 4,680,884 | 7/1987 | Smith, Jr. et al. | 42/66 |
| 4,897,951 | 2/1990 | Osborne | 42/70.06 |
| 4,926,575 | 5/1990 | Pastor | 42/70.06 |
| 5,067,266 | 11/1991 | Findlay | 42/70.08 |
| 5,303,494 | 4/1994 | Tuma et al. | 42/70.04 |
| 5,560,132 | 10/1996 | Merlino | 42/66 |

FOREIGN PATENT DOCUMENTS

| | | | |
|---|---|---|---|
| 1917716 | 10/1970 | Germany | 42/66 |
| 2113745 | 10/1972 | Germany | 42/66 |

*Primary Examiner*—Stephen M. Johnson
*Attorney, Agent, or Firm*—Antonio R. Durando

[57] ABSTRACT

A firearm has a hammer and a trigger. The trigger abuts the lower end of a safety, and one or more springs urge the hammer down and constantly bias the safety towards a safe range. The upper part of the safety has a gap, and a sear is mounted coaxially with the safety in alignment with the gap. When the hammer is down, a nose on the hammer extends into the gap while lugs on the hammer engage abutment surfaces of the safety and prevent the latter from moving to its safe range. Partial cocking of the hammer causes the lugs to release the safety which is thereupon urged into such range. In the safe range, shoulders on the safety located opposite the abutment surfaces can engage the lugs to hold the hammer in a half-cocked position with the hammer nose contacting the sear. Further cocking of the hammer causes the lugs to become disengaged from the shoulders and the nose to release the sear. The safety remains in its safe range while the sear is moved underneath the nose of the hammer to hold it in a fully cocked position. If the trigger is pulled, it forces the safety out of its safe range and the safety, in turn, moves the sear out of engagement with the hammer.

17 Claims, 4 Drawing Sheets

FIREARM WITH SAFETY

BACKGROUND OF THE INVENTION

1. Field of the Invention

The invention relates to a firearm.

2. Description of the Prior Art

Firearms are generally equipped with a safety mechanism in order to prevent accidental firing. These safety mechanisms take various forms.

U.S. Pat. Nos. 2,856,718 and 4,926,575 employ a rod movable between a firing position and a safe position in which the action is locked. On the other hand, U.S. Pat. Nos. 3,120,713 and 3,735,519 use a slide to block the sear while U.S. Pat. No. 5,303,494 employs a rotary shaft for this purpose. U.S. Pat. No. 4,897,951 describes a pivotal arm having a locking dog which can engage a notch on the trigger to immobilize the latter.

The safety mechanisms in the preceding patents are operable manually. Hence, if a user forgets to place the firearm in a safe condition, the firearm can fire accidentally.

This problem is avoided in U.S. Pat. Nos. 3,777,384; 4,173,964; and 4,680,884 where the firearm automatically assumes a safe condition upon being fired. However, the firearms described in these patents go off safety when they are fully cocked so that the firearms cannot be safely carried in this condition.

U.S. Pat. No. 5,067,266 also discloses a firearm which is automatically placed in a safe condition when fired. This firearm is equipped with a rod which can be moved in front of the hammer when the hammer is fully cocked. Since the rod prevents the hammer from touching the firing pin, the firearm is unable to fire accidentally even when in the fully cocked condition.

As is the case in U.S. Pat. Nos. 2,856,718 and 4,926,575, the rod is designed to be manipulated manually. Accordingly, the firearm of U.S. Pat. No. 5,067,266 can fire accidentally if a user places the hammer in its fully cocked position but fails to move the rod in front of the hammer.

SUMMARY OF THE INVENTION

It is an object of the invention to provide a firearm which can be placed in a fully cocked and yet safe condition using the normal motions of firearm operation.

Another object of the invention is to provide a method which enables a firearm to be brought into a fully cocked yet safe condition without special motions such separate operation of a safety.

The preceding objects, as well as others which will become apparent as the description proceeds, are achieved by the invention.

One aspect of the invention resides in a firearm. The firearm comprises a striking member, e.g., a hammer, movable between a fully cocked position and an uncocked position; a safety movable between an inactive position and a blocking position in which the safety blocks the striking member from the uncocked position when the striking member is in the fully cocked position; and a biasing member arranged to urge the safety into the blocking position in response to movement of the striking member from the uncocked position towards the fully cocked position.

The firearm of the invention is placed in a safe condition by moving a safety to a position in which the safety blocks a fully cocked striking member, such as a hammer, from reaching an uncocked position. The safety enters the blocking position in response to movement of the striking member from the uncocked position towards the fully cocked position. Inasmuch as cocking involves a normal or natural motion in firearm operation, the firearm according to the invention can thus automatically be brought into a fully cocked yet safe condition using a motion which is natural for a firearm user.

Another aspect of the invention resides in a method of operating a firearm having a striking member and a trigger. The method comprises the steps of moving the striking member from an uncocked position to a fully cocked position, and establishing a block to movement of the striking member from the fully cocked position to the uncocked position. The establishing step is performed in response to the moving step.

The method can further comprise the steps of pulling the trigger, and removing the block in response to the pulling step.

The block may be established in response to placement of the striking member in a partly cocked position.

Additional features and advantages of the invention will be forthcoming from the following detailed description of certain preferred embodiments when read in conjunction with the accompanying drawings.

DESCRIPTION OF THE PREFERRED EMBODIMENTS

Figure 1:
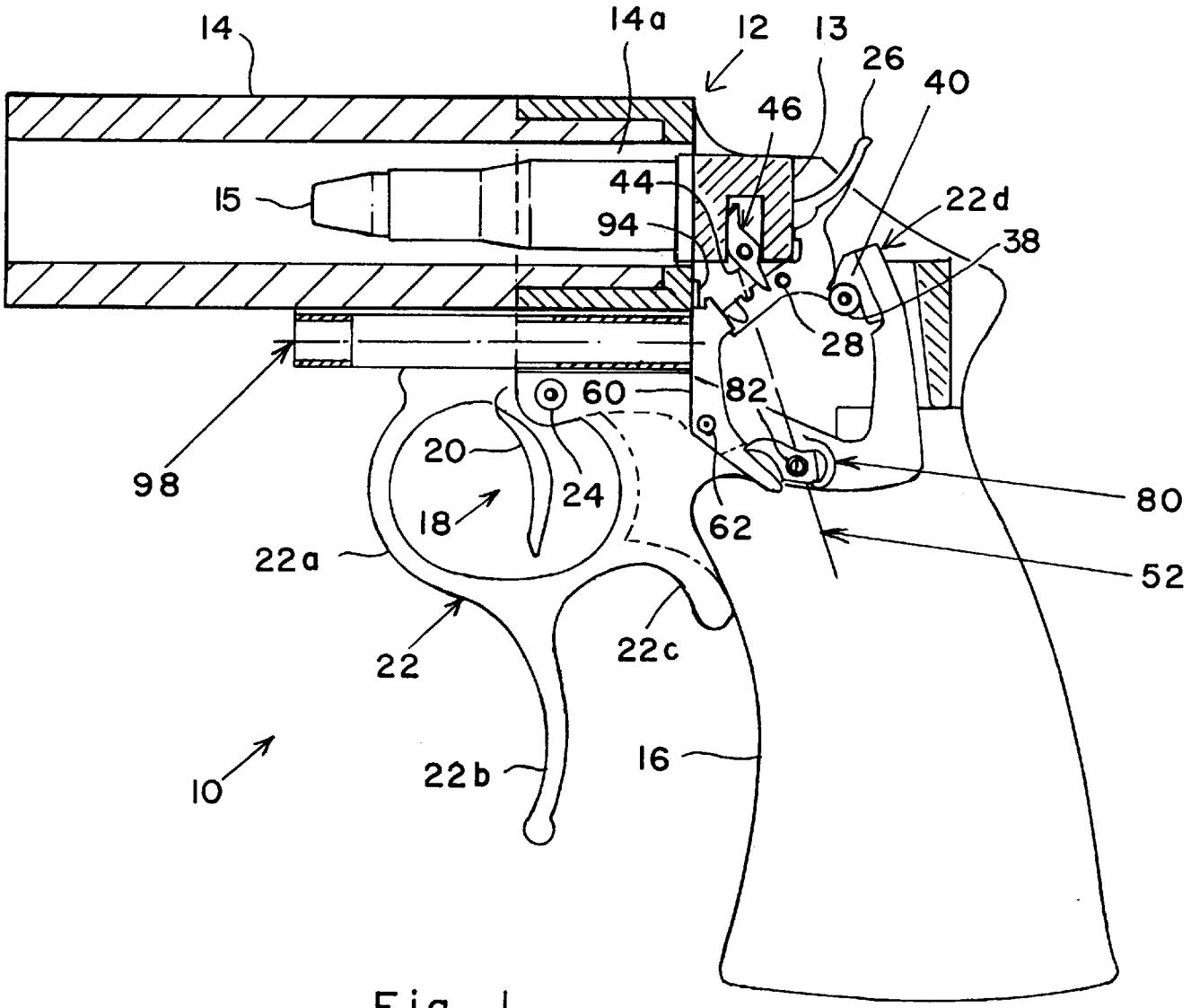
FIG. 1 is a partly sectional side view of a firearm in accordance with the invention.

Referring to FIG. 1, a firearm in accordance with the invention is identified by the numeral 10. The firearm 10 is here shown as a hunting pistol by way of example but the invention is not limited to a firearm of this type. In the description which follows, directions of movement, and terms denoting position, e.g., upper, are based on the orientation of the firearm 10 in FIG. 1.

The firearm 10 comprises a frame 12, and a breechblock 13 which is mounted on the frame 12 for sliding movement vertically. A barrel 14 screws into the front of the frame 12, and a cartridge chamber 14*a* is located at the rear of the barrel 14 and accommodates a cartridge 15. The frame 12 is integral with a grip 16 which projects downward and rearward from the frame 12.

The firearm 10 further comprises an action 18 which includes a trigger 20 and an operating lever 22. The trigger 20 and operating lever 22 are pivotally mounted on the frame 12 by a pivot pin 24 located in the front lower corner of the frame 12.

The operating lever 22 includes a trigger guard 22*a,* an opening finger spur 22*b,* a closing finger spur 22*c,* and a cocking arm 22*d* which is situated at the rear of the operating lever 22 and extends upward. The operating lever 22 also includes a pair of fingers which are not visible in FIG. 1, and the ends of the fingers are formed with balls which are received by slots in the breechblock 13. The fingers move the breechblock 13 down to open the same when the operating lever 22 is swung downward while the fingers move the breechblock 13 up to a closed position as the operating lever 22 is swung upward. The operating lever 22 is provided with a boss for the pivot pin 24, and the boss again cannot be seen in FIG. 1.

The operating lever 22 may be a rigid single piece. However, it is also possible to make the cocking arm 22*d* adjustable relative to the remainder of the operating lever 22.

Figure 2:
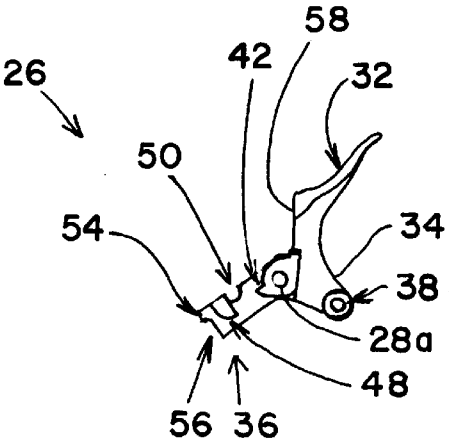
FIG. 2 is a side view of a hammer constituting part of the firearm.

The trigger 20 of the action 18 is disposed inside the trigger guard 22*a* of the operating lever 22. The action 18 additionally includes a hammer or striking member 26 which is pivotally mounted on the breechblock 13 by a pivot pin 28. Considering FIG. 2 in conjunction with FIG. 1, the hammer 26 includes a spur 32, a cocking skirt 34 and an arm 36. The cocking skirt 34 is provided with a pair of cocking rollers 38 which, as illustrated in FIG. 1, are engaged by respective hooks 40 on the cocking arm 22*d*. Only one of the cocking rollers 38, and only one of the hooks 40, is visible in the drawings. The cocking rollers 38 and hooks 40 may be eliminated and can, for example, be replaced by a notch or notches in the cocking skirt 34 and a protrusion or bump on the cocking arm 22*d*.

The arm 36 of the hammer 26, which constitutes a sear arm, is formed with a pair of camming surfaces 42. Per FIG. 1, the camming surfaces 42 bear against respective legs 44 of a firing pin retractor 46. Only one of the camming surfaces 42, and only one of the legs 44, is visible in the drawings. The sear arm 36 is further provided with a pair of lateral lugs or protrusions 48 of which again only one is visible in the drawings. Between the pair of camming surfaces 42 and the pair of lugs 48 is a groove or slot 50 which receives a hook at one end of an elongated mainspring 52, e.g., a coil spring, denoted by its longitudinal axis in FIG. 1. The end of the sear arm 36 remote from the cocking skirt 34 has a nose or projection 54 which defines a shoulder or abutment 56 constituting, or constituting part of, a full cock notch or sear notch. A bore 28*a* for the hammer pivot pin 28 traverses the sear arm 36.

An impact surface 58 is located between the spur 32 and the sear arm 36. The impact surface 58 functions to strike a non-illustrated firing pin when the firearm 10 is fired.

Figure 4:
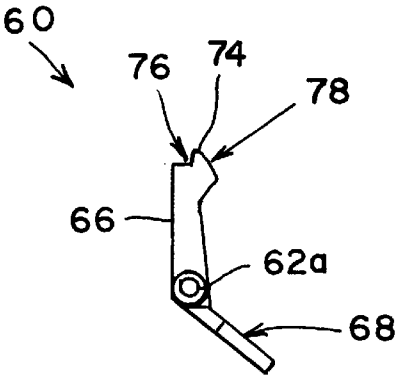
FIG. 4 is a side view of the safety.
Figure 3:
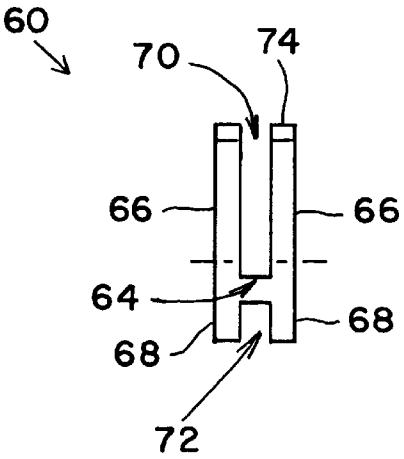
FIG. 3 is an elevation of a safety forming part of the firearm.

With reference to FIGS. 1, 3 and 4, the action 18 further comprises a safety 60 which is constituted by a lever and is pivotally mounted on the breechblock 13 by a pivot pin 62. The safety 60 resembles an H as seen in the elevation of FIG. 3 and includes a crosspiece or bridge 64, a pair of legs 66 extending to one side of the crosspiece 64, and a pair of legs 68 extending to the opposite side of the crosspiece 64. The legs 66 are inclined with reference to, and define an obtuse angle with, the legs 68. Thus, the safety 60 is V-shaped as seen in the side view of FIG. 4. Aligned bores 62*a* extend through the legs 66 and are designed to accommodate the safety pivot pin 62.

The legs 66 define a first gap 70 while the legs 68 define a second gap 72. The ends of the legs 66 remote from the crosspiece 64 have noses or projections 74 which define shoulders or abutments 76. The shoulders 76 are disposed at one side of the noses 74, and bearing or abutment surfaces 78 are provided on the legs 66 at the opposite side of the noses 74. When the hammer 26 is down, that is, in an uncocked or released position, the nose 54 of the hammer 26 projects into the gap 70 between the legs 66 while the lugs 48 of the hammer 26 bear against the bearing surfaces 78. This is shown in FIG. 1.

Figure 7:
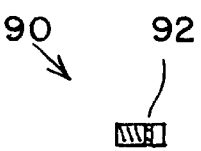
FIG. 7 is a side view of an adjusting screw for the rocker.
Figure 6:
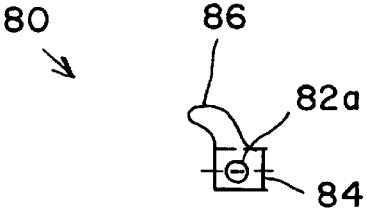
FIG. 6 is a side view of the rocker.
Figure 5:
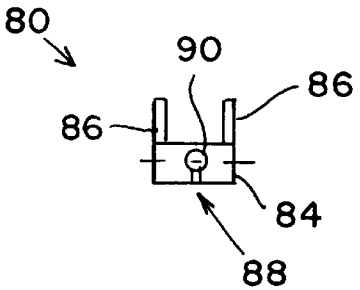
FIG. 5 is an elevation of a rocker constituting part of the firearm.

Turning to FIGS. 5, 6 and 7 in conjunction with FIG. 1, the action 18 also comprises a rocker or biasing member 80 which is pivotally mounted in the breechblock 13 by a pair of pivot pins 82. Only one of the pivot pins 82 is visible in the drawings. The rocker 80 is U-shaped as seen in the elevation of FIG. 5 and includes a block 84 which constitutes a crosspiece or bridge. A pair of curved arms 86 projects to one side of the block 84, and the arms 86 continuously bear against the legs 68 of the safety 60.

The block 84 is provided with a bore 82*a* for the rocker pivot pins 82 and with a slot 88 which extends into the block 84 from the side of the latter opposite the arms 86. The block 84 is threaded at the end of the slot 88 nearest the arms 86 in order to accommodate an adjusting screw 90. The adjusting screw 90 is formed with a circumferential groove 92 which receives a hooked end of the mainspring 52 opposite the end which engages the hammer 26. The slot 88 in the block 84 provides the mainspring 52 with access to the groove 92 and helps hold the mainspring 52 in position laterally.

The mainspring 52 is a tension spring which, as seen in FIG. 1, urges the hammer 26 counterclockwise to its uncocked position and urges the rocker 80 counterclockwise into abutment with the safety 60. The rocker 80, in turn, biases the safety 60 towards a safe or blocking position in which the safety 60 blocks the hammer 26 when the latter is in a half-cocked or fully cocked position so that the hammer 26 is unable to return to its uncocked position.

The adjusting screw 90 is normal or approximately normal to the longitudinal axis of the mainspring 52. Accordingly, rotation of the adjusting screw 90 effectively changes the length of the lever arm urging the rocker 80 counterclockwise, i.e., effectively changes the distance between the rotational axis of the rocker 80 and the point at which the mainspring 52 is anchored to the rocker 80. This permits the biasing force on the rocker 80 to be increased or decreased while leaving the force on the hammer 26 essentially unchanged.

The rocker pivot pins 82 and the adjusting screw 90 are perpendicular or approximately perpendicular to one another. The rocker 80 is mounted in the firearm 10 so that the adjusting screw 90 registers with the gap 72 in the safety 60. This makes the adjusting screw 90 accessible for adjustment.

It is preferred for the longitudinal axis of the adjusting screw 90 to be located at a different level than the longitudinal axes of the rocker pivot pins 82. Advantageously, the longitudinal axis of the adjusting screw 90 is disposed slightly above the longitudinal axes of the rocker pivot pins 82. The groove 92 in the adjusting screw 90 is then preferably designed so that a predetermined plane containing the longitudinal axes of the rocker pivot pins 82 is tangent to the bottom surface of the groove 92. The predetermined plane is parallel to planes which, in turn, are parallel to the longitudinal axes of the adjusting screw 90 and the rocker pivot pins 82.

Figure 8:
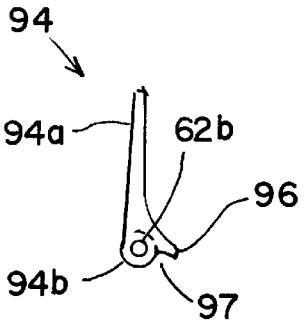
FIG. 8 is a side view of a sear forming part of the firearm.

Considering FIGS. 1 and 8, the action 18 further includes a sear or holding member 94 which is pivotally mounted on the breechblock 13 by the safety pivot pin 62. The sear 94 comprises an elongated blade or element 94*a* having a lower end 94*b* which is formed with a bore 62*b* for the pivot pin 62. A nose or protrusion 96 projects downward from the end 94*b* and faces the cocking arm 22*d*. The nose 96 cooperates with the end 94*b* to define a notch or groove at the lower side of the nose 96.

The sear 94 is in alignment with the gap 70 in the safety 60. The width of the sear 94, as considered normal to FIG. 8, is smaller than the width of the gap 70 so that the sear 94 can enter the gap 70. The nose 96 of the sear 94 has a downwardly directed surface 97 which faces the end 94*b* of the sear 94 and bounds the notch at the lower side of the nose 96 on one side. The surface 97 can be engaged by the crosspiece 64 of the safety 60 when the safety 60 is rotated counterclockwise from its blocking position to an inactive position. The nose 96 and crosspiece 64 may be situated at locations of the sear 94 and safety 60 other than those illustrated.

As shown in FIG. 1, the firearm 10 is provided with a mechanism 98 which can be of conventional construction and comprises a non-illustrated sear stop screw, a non-illustrated sear spring and a non-illustrated sear plunger. The sear 94 is biased in a clockwise direction by way of the sear spring and sear plunger which can be adjusted to change the force on the sear 94. The sear spring and sear plunger urge the sear 94 to an intercepting position in which the sear 94 engages the hammer 26 when the latter is in its fully cocked position. The sear 94 then prevents the hammer 26 from moving to its uncocked position.

The sear spring and sear plunger can be eliminated by designing the sear 94 and the safety 60 so that the latter urges the sear 94 to the intercepting position.

The operation of the firearm 10 will be described with reference to FIGS. 9, 10, 11 and 12. However, before outlining the operation of the firearm 10, it will be observed from FIG. 10 that the trigger 20 includes an elongated finger grip 100, and a pair of arms 102 and 104 extending in opposite directions from one end of the finger grip 100. The finger grip 100 is engaged by the finger of a user to pull the trigger 20 when the firearm 10 is to be fired.

The end of the arm 102 remote from the finger grip 100 is formed with a bore 24*a* for the pivot pin 24 which supports the trigger 20 and the operating lever 22. On the other hand, the end of the arm 104 remote from the finger grip 100 is provided with a pair of rollers 106 of which only one is visible in the drawings. The rollers 106, which can be replaced by protrusions or bumps, bear against the legs 68 of the safety 60.

The trigger 20 is disposed on the opposite side of the safety 60 from the rocker 80 so that the rollers 106 and safety 80 are in engagement with opposite surfaces of the legs 68. When the trigger 20 is pulled to fire the firearm 10, the trigger 20 is rotated counterclockwise, as seen in FIGS. 1 and 10, against the biasing action of the rocker 80.

Figure 9:
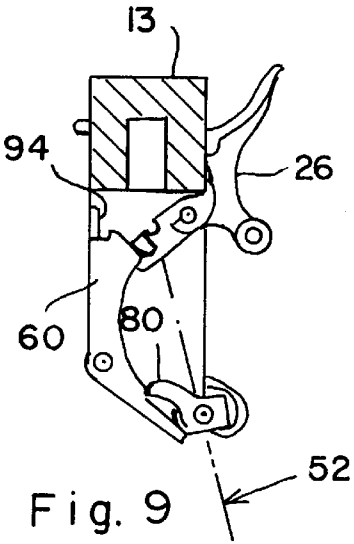
FIG. 9 is a side view of the action of the firearm immediately after firing of the firearm.

The operation of the firearm 10 will be explained assuming that the firearm 10 has just been fired and the trigger 20 released. This condition of the firearm 10 is shown in FIG. 9 where the hammer 26 is down, that is, where the hammer 26 is in its uncocked or released position. The firing pin is forward and the safety 60 is in an inactive forward position. Since the trigger 20 has been released, the rocker 80 is free to bias the safety 60 clockwise towards its safe position. However, the lugs 48 of the hammer 26 engage the bearing surfaces 78 of the safety 60 and prevent rotation of the safety 60 to the safe position. The nose 54 of the hammer 26 projects into the gap 70 of the safety 60, and the sear 94 bears against the nose 54 under the action of the sear spring and sear plunger.

Figure 10:
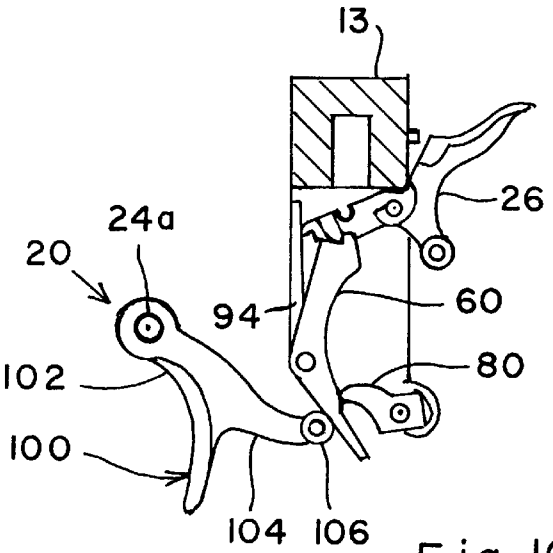
FIG. 10 is a side view of the action in a half-cocked condition of the firearm.

With reference to FIG. 10, if the hammer 26 is rotated clockwise away from its uncocked position either by thumbing back the hammer 26 or by rotating the operating lever 22, the nose 54 of the hammer 26 moves upward along the sear 94. This causes the sear 94 to rotate slightly counterclockwise against the action of the sear spring and sear plunger. As the nose 54 moves upward along the sear 94, the lugs 48 move upward along the bearing surfaces 78 towards the noses 74 of the safety 60. When the lugs 48 pass over the noses 74, the rocker 80 rotates the safety 60 clockwise to its safe or blocking position while rotating the trigger 20 clockwise to a rest position. At the moment that the lugs 48 pass over the noses 74, the nose 54 of the hammer 26 still abuts the sear 94. If the hammer 26 is now allowed to rotate counterclockwise under the action of the mainspring 52 back towards its uncocked position, the lugs 48 come to rest against the shoulders 76 of the safety 60. The hammer 26 is then in its half-cocked position, and the safety 60 prevents further rotation of the hammer 26 towards the uncocked position. During the counterclockwise rotation of the hammer 26 back towards its uncocked position, the sear 94 remains in sliding contact with the nose 54 of the hammer 26 by rotating slightly clockwise under the action of the sear spring and sear plunger. The firing pin is locked to the rear in preparation for firing as the hammer 26 is moved from its uncocked position to its half-cocked position.

With the hammer 26 in its half-cocked position, the trigger 20 cannot be pulled, i.e., rotated counterclockwise, to fire the firearm 10. Thus, the rollers 106 of the trigger 20 bear against the legs 68 of the safety 60. If an attempt is made to pull the trigger 20, the trigger 20 simply urges the safety 60 counterclockwise into tighter engagement with the lugs 48 of the hammer 26. The trigger 20 is accordingly locked.

The trigger 20 can be unlocked only by rotating the hammer 26 clockwise beyond its half-cocked position sufficiently for the lugs 48 to clear the noses 74 of the safety 60. As the hammer 26 is rotated, the nose 54 of the hammer 26 moves upward along the sear 94 thereby causing the latter to rotate slightly counterclockwise against the action of the sear spring and sear plunger.

Figure 11:
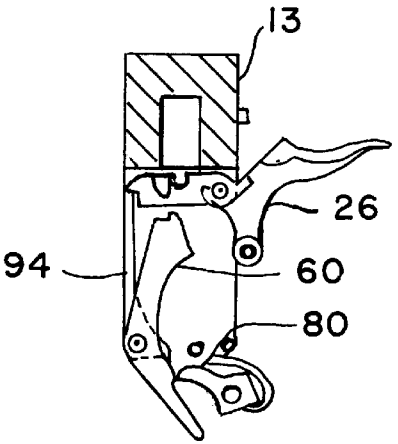
FIG. 11 is a side view of the action in a fully cocked and safe condition of the firearm.

Considering FIG. 11, it is assumed that the trigger 20 is allowed to remain in the rest position of FIG. 10. If the hammer 26 is rotated clockwise from its half-cocked position sufficiently far for the nose 54 of the hammer 26 to pass the upper end of the sear 94, the sear 94 is urged clockwise into its intercepting position under the action of the sear spring and sear plunger. In the intercepting position, the sear 94 engages the shoulder 56 of the hammer 26. The hammer 26 is now in its fully cocked position and is retained in this position by the sear 94. As long as the trigger 20 is not pulled, the safety 60 is held in its safe position by the biasing action of the rocker 80.

The hammer 26 is normally brought to its fully cocked position only when a user believes that she/he is ready to fire. However, it frequently happens that the user decides not to fire after fully cocking the hammer 26, especially when hunting. Under such circumstances, it is highly desirable to prevent accidental firing of the firearm 10.

Even should the firearm 10 be jarred, e.g., by dropping the firearm 10, two security features operate to prevent the hammer 26 from falling to its uncocked position with resultant firing of the firearm 10. First, the strong biasing force with which the sear spring and sear plunger urge the sear 94 towards the hammer 26, and the aggressive angle of engagement of the sear 94 and hammer 26, make it highly unlikely that the sear 94 would become disengaged from and release the hammer 26. Second, since the safety 60 remains in its safe position as long as the trigger 20 is not pulled, the safety 60 blocks a return of the hammer 26 to its uncocked position in the event that the sear 94 is jarred loose from the hammer 26. Thus, if the sear 94 becomes disengaged from the hammer 26 and the latter falls, the lugs 48 of the hammer 26 come into engagement with the shoulders 76 of the safety 60 so that the hammer 26 is arrested in its half-cocked position. The firearm 10 is then in the condition of FIG. 10.

Returning to FIG. 11, it is assumed that a user has decided to pull the trigger 20. This action involves two stages.

During the first stage of trigger pull, the trigger 20 rotates the safety 60 counterclockwise out of its safe position against the resistance of the rocker 80. When the safety 60 approaches the end of its counterclockwise rotation, the crosspiece 64 of the safety 60 comes into abutment with the surface 97 of the nose 96 on the sear 94. Due to the aggressive angle of engagement of the sear 94 and the hammer 26, as well as the strong biasing force with which the sear 94 is urged clockwise by the sear spring and sear plunger, the user now experiences additional resistance to pulling of the trigger 20. This completes the first stage of trigger pull.

Figure 12:
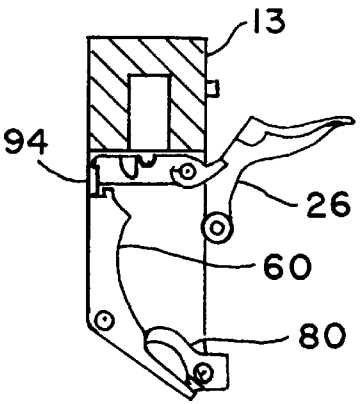
FIG. 12 is a side view of the action in a fully cocked condition of the firearm immediately prior to firing of the firearm.

The condition of the firearm 10 at the end of the first stage of trigger pull is shown in FIG. 12. If a decision is made not to fire and the trigger 20 is released, the rocker 80 rotates the safety 60 clockwise back to its safe position thereby returning the firearm 10 to the condition of FIG. 11.

Assuming that the firearm 10 is to be fired, the second stage of trigger pull is initiated. During the second stage of trigger pull, the safety 60 is rotated further counterclockwise from the position of FIG. 12. Since the crosspiece 64 of the safety 60 engages the surface 97 of the nose 96 on the sear 94, the safety 60 entrains the sear 94 and urges the latter counterclockwise to an inoperative position out of engagement with the hammer 26. This allows the hammer 26 to fall to its uncocked position and drive the firing pin forward to ignite the primer. Counterclockwise rotation of the safety 60 and sear 94 is stopped by a non-illustrated, adjustable overtravel screw which is concentric with the sear plunger and may be designed and mounted in a conventional fashion. Alternatively, counterclockwise rotation of the safety 60 and sear 94 may be stopped by abutment of the sear 94 against the rear of the barrel 14.

As mentioned earlier, the firing pin is locked to the rear during movement of the hammer 26 from its uncocked position to its half-cocked position. The firing pin remains locked to the rear until the last few degrees of hammer fall when the firing pin is unlocked to permit the hammer 26 to drive it forward. Such locking and unlocking of the firing pin can be performed in a conventional manner.

At the end of the second stage of trigger pull, the trigger 20 is in a firing or "fired" position. When the trigger 20 is released following firing, the rocker 80 urges the safety 60 clockwise back towards its safe position thereby causing the bearing surfaces 78 of the safety 60 to abut the lugs 48 of the hammer 26. The safety 60, in turn, rotates the trigger 20 clockwise from its firing position towards its rest position. Furthermore, the sear 94 is urged clockwise out of its inoperative position by the sear spring and sear plunger so that the sear 94 comes to bear against the nose 54 of the hammer 26. In this manner, the firearm 10 is returned to the condition of FIG. 9.

As outlined above, the firearm 10 can be returned to the condition of FIG. 11 during the first stage of trigger pull by simply releasing the trigger 20. Alternatively, the firearm 10 can be returned to the half-cocked condition of FIG. 10. This operation of "decocking the hammer down to half cock" is accomplished by rotating the hammer 26 beyond its fully cocked position and subsequently initiating the second stage of trigger pull to rotate the sear 94 out of the path of the hammer 26. The hammer 26 is then lowered to a position in which the nose 54 of the hammer 26 is below the upper end of the sear 94 and the lugs 48 of the hammer 26 are above the noses 74 of the safety 60. If the trigger 20 is now released, the rocker 80 is able to rotate the safety 60 to its safe position thereby allowing the lugs 48 of the hammer 26 to move into engagement with the shoulders 76 of the safety 60.

Rotation of the trigger 20 during the first stage of trigger pull is opposed by the rocker 80. Since the biasing action of the rocker 80 can be adjusted by turning the adjusting screw 90, the force required for the first stage of trigger pull is adjustable via the adjusting screw 90.

During the second stage of trigger pull, rotation of the trigger 20 occurs against the resistance of not only the rocker 80 but also the sear spring and sear plunger. The force required for the second stage of trigger pull, which is mainly a function of the angle of engagement of the sear 94 and hammer 26, can thus be varied by adjusting the sear spring and sear plunger.

The adjusting screw 90 is independent of the sear spring and sear plunger. This enables the force for the second stage of trigger pull to be tuned relative to the force for the first stage.

The action 18 can be operated using the same motions as for the action of a traditional lever-action rifle or a revolver with a conventional half cock type of safety. This reduces the likelihood of error in the operation of the firearm 10 and makes it unnecessary to learn new movements in order to bring the firearm 10 into a fully cocked yet safe condition. Nor must a user remember to operate a special button, slide or lever to obtain a fully cocked and safe condition. In fact, the action 18 enables such a condition to be achieved with no conscious effort.

The safety 60 is integral to the operation of the firearm 10 which, without major modifications, will not operate if the safety 60 is removed. Thus, the trigger 20 operates on the safety 60 rather than the sear 94 and would have no contact with the sear 94 should the safety 60 be deleted. Moreover, it is not possible to override or circumvent the safety 60 short of major modifications. The safety 60 is designed so that it can be installed only in its correct position and is movable between its inactive and safe positions virtually noiselessly when the hammer 26 is in its fully cocked position. Quiet operation of the safety 60 is of particular importance to hunters.

Unlike conventional firearms, operation of the action 18 does not require the sear 94 to engage a safety notch in the hammer 26. Sears and safety notches which engage one another are easily broken or damaged if a firearm is dropped thereby leading to impaired function.

The rocker 80 constantly urges the safety 60 towards its safe position. Consequently, the firearm 10 tends to automatically assume a safe condition whenever the action 18 is operated. Since the rocker 80 acts in opposition to the trigger 20, the firearm 10 likewise tends to automatically assume a safe condition when the trigger 20 is released.

The rocker 80 delivers power to the safety 60 from the strongest spring in the firearm 10, namely, the mainspring 52. This increases the operating reliability of the safety 60. Although pulling of the trigger 20 occurs in opposition to the action of the rocker 80, and hence against the force of the mainspring 52, the rocker 80 permits the force transmitted by the mainspring 52 to be reduced so that the trigger 20 can be pulled using normal finger pressure. This can be accomplished by making the lever arm over which the mainspring 52 acts on the rocker 80 short.

The adjusting screw 90 allows the biasing action of the rocker 80 to be varied without appreciably changing the force to the hammer 26 even though both the rocker 80 and the hammer 26 are subjected to the action of the mainspring 52. This is due to the fact that the mainspring 52 is anchored to the adjusting screw 90 which, in turn, is mounted on the rocker 80 so as to be perpendicular or approximately perpendicular to the longitudinal axis of the mainspring 52. By virtue of such arrangement, rotation of the adjusting screw 90 effectively changes the length of the lever arm over which the mainspring 52 acts on the rocker 80 without significantly affecting the action of the mainspring 52 on the hammer 26.

The rocker 80 and adjusting screw 90 constitute a simple means for adjusting the force during the first stage of trigger pull to suit intended use.

Since the action 18 has relatively few parts and can be constructed so that the sweep of each of the safety 60, rocker 80 and sear 94 is short, the action 18 can be quite compact. Furthermore, the action 18 can be designed to be relatively short as considered in a direction parallel to the barrel 14 of the firearm 10. This enables the center of gravity of the firearm 10 to be set slightly to the rear and, for a given overall length of the firearm 10, permits the length of the barrel 14 to be increased. In the case of a rifle or similar firearm, a relatively short length of the action 18 allows the ocular of a scope of normal eye-relief to be mounted at or ahead of the breech face. Such mounting makes it possible to provide strong support for the scope and to avoid the unwieldy cantilever effect resulting from a long rearward extension of the scope tube.

The action 18 can also be designed to be relatively light. For a given weight of the firearm 10, this permits the barrel 14 to be made heavier and stiffer.

The safety 60 constitutes a lever which is stressed mainly in compression by the hammer 26. The hammer 26, in turn, cooperates with the safety 60 by way of the lugs 48 which can be made quite strong. These features enable the action 18 to have a sturdy construction.

The action 18 is fairly simple and has relatively few parts thereby allowing the firearm 10 to be produced relatively inexpensively.

Figure 13:
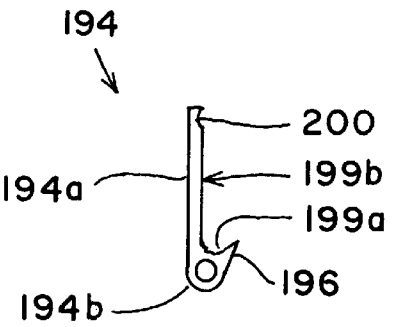
FIG. 13 is a side view of another embodiment of a sear for a firearm according to the invention.

Another embodiment of a sear is shown in FIG. 13 where the same reference numerals as in FIG. 8, plus 100, are used to identify similar parts.

The sear 194 of FIG. 13 differs from the sear 94 of FIG. 8 in that the nose 196 of the sear 194 projects upward from the lower end 194*b* of the sear 194. The nose 196 cooperates with the blade 194*a* of the sear 194 to define a notch or groove at the upper side of the nose 196. The nose 196 has an upwardly directed surface 199*a* which bounds the notch on one side while the blade 194*a* has a surface 199*b* which bounds the notch on the opposite side.

The surface 199*b* includes a part-circular arc or surface segment 200 at the upper end of the blade 194*a*. The surface segment 200 has a radius of curvature equal to the distance between the pivot axis and the tip of the nose 54 of the hammer 26.

Figure 14:
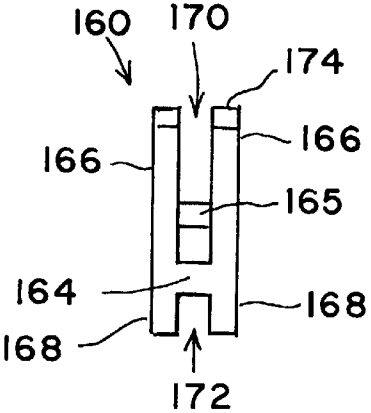
FIG. 14 is an elevation of a further embodiment of a safety for use with the sear of FIG. 13.

The sear 194 is designed for operation with a safety illustrated in FIG. 14 where the same reference numerals as in FIG. 3, plus 100, are used to denote similar parts.

The safety 160 of FIG. 14 is the same as the safety 60 of FIG. 3 except that the safety 160 is provided with a second crosspiece 165 above the crosspiece 164. The crosspiece 165 is receivable in the notch of the sear 194.

As mentioned previously, the sear 94 of FIG. 8 is urged to its intercepting position by a sear spring and sear plunger. The combination of the sear 194 and safety 160 makes it possible to eliminate the sear spring and sear plunger thereby allowing the firearm 10 to be simplified.

The operation of the firearm 10 with the sear 194 and the safety 160 is as follows:

With the hammer 26 in the uncocked position of FIG. 9, the crosspiece 165 of the safety 160 abuts the surface 199*b* of the sear blade 194*a*. The crosspiece 165 holds the sear 194 away from the hammer 26 so that the nose 54 of the hammer 26 is spaced from the sear 194.

If the hammer 26 is now rotated clockwise away from its uncocked position sufficiently for the lugs 48 to pass over the noses 174 of the safety 160, the rocker 80 rotates the safety 160 clockwise to a first safe position. The first safe position is identical to the safe position of the safety 60 and is that shown in FIG. 10. During the clockwise rotation of the safety 160, the crosspiece 165 moves out of engagement with the surface 199*b* of the sear blade 194*a*. In the first safe position of the safety 160, which corresponds to the half-cocked position of the hammer 26, the crosspiece 165 just contacts the surface 199*a* of the nose 196 of the sear 194. Furthermore, the nose 54 of the hammer 26 abuts the lower end of the arc 200 of the surface 199*b* of the sear blade 194*a*.

Upon clockwise rotation of the hammer 26 from its half-cocked position towards its full-cocked position, the nose 54 of the hammer 26 moves upward along the arc 200. Although the sear 194 is constrained against clockwise rotation by the nose 54 and against counterclockwise rotation by the crosspiece 165 of the safety 160, the nose 54 can slide along the arc 200 with relative ease. Thus, the radius of curvature of the path traveled by the tip of the nose 54 equals the radius of curvature of the arc 200.

When the nose 54 passes over the upper end of the sear blade 194*a*, the sear 194 becomes free to rotate clockwise. The rocker 80 urges the safety 160 clockwise to a second safe position and since, as mentioned earlier, the crosspiece 165 of the safety 160 contacts the surface 199*a* of the sear nose 196, the crosspiece 165 rotates the sear 194 clockwise. The clockwise rotation of the safety 160 and sear 194, which is relatively small, moves the sear 194 into the intercepting position where the sear 194 engages the shoulder 56 of the hammer 26 and holds the latter in its fully cocked position. Upon abutment of the sear 194 with the shoulder 56, further clockwise rotation of the sear 194 and safety 160 is inhibited. With the safety 160 in its second safe position, the situation is almost identical to that depicted in FIG. 11. The only difference is that the second safe position of the safety 160 is located slightly clockwise of the safe position of the safety 60.

The mainspring 52 continues to bias the rocker 80, and hence the safety 160 and sear 194, clockwise in the second safe position of the safety 160. The strong biasing force of the mainspring 52, in conjunction with the aggressive angle of engagement of the sear 194 and the hammer 26, make it very unlikely that the sear 194 would become disengaged from and release the hammer 26 in the event that the firearm 10 is jarred. However, even should this occur, the safety 160 catches the hammer 26 and prevents the latter from falling to its uncocked position and discharging the firearm 10.

As before, the action of pulling the trigger 20 with the hammer 26 in its fully cocked position involves two stages. During the first stage of trigger pull, the trigger 20 rotates the safety 160 counterclockwise out of the second safe position and through the first safe position. This causes the crosspiece 165 of the safety 160 to move out of engagement with the surface 199*a* of the sear nose 196. When the safety 160 approaches the end of its counterclockwise rotation, the crosspiece 165 comes into contact with the surface 199*b* of the sear blade 194*a*. As a result of the aggressive angle of engagement of the sear 194 and the hammer 26, the user of the firearm 10 then feels additional resistance to pulling of the trigger 20. This is the end of the first stage of trigger pull as illustrated in FIG. 12.

Release of the trigger 20 after the first stage of trigger pull allows the rocker 80 to rotate the safety 160 clockwise back to its second safe position.

If the trigger 20 is not released following the first stage of trigger pull and the firearm 10 is to be fired, the user continues to squeeze the trigger 20 thereby initiating the second stage of trigger pull. The trigger 20 rotates the safety 160 counterclockwise from the position of FIG. 12 and the safety 160, in turn, rotates the sear 194 counterclockwise since the crosspiece 165 of the safety 160 bears against the surface 199*b* of the sear 194. Due to the counterclockwise rotation of the sear 194, the latter moves out of engagement with the shoulder 56 of the hammer 26 so that the hammer 56 is free to fall to its uncocked position and cause the firearm 10 to discharge.

When the trigger 20 is released subsequent to firing, the firearm 10 is returned to the condition of FIG. 9.

The crosspiece 164 of the safety 160 can be eliminated. However, it is preferred to incorporate the crosspiece 164 in the safety 160 for added strength.

The rocker 80 permits the firearm 10 to have a compact construction and is used with advantage where space is limited. If sufficient space is available, it is possible to omit the rocker 80 as illustrated in FIGS. 15–17.

Figure 15:
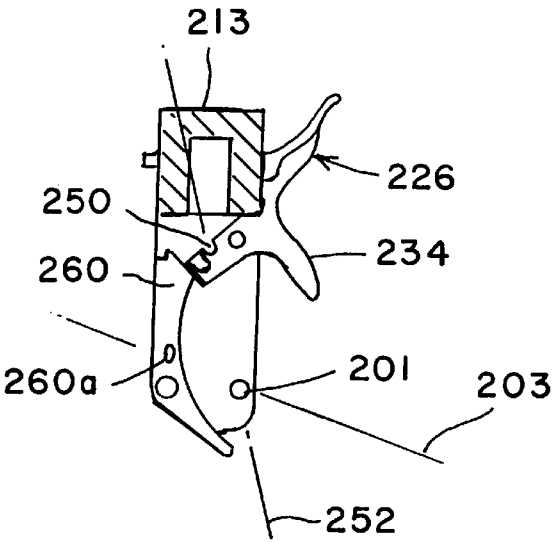
FIG. 15 is a side view of another embodiment of an action for a firearm in accordance with the invention.

Considering FIG. 15, the same numerals as in FIG. 9, plus 200, are used to identify corresponding elements. A peg 201 is fixed to the breechblock 213, and a hole 260*a* is formed in the safety 260 at a level above the bores 262*a* for the safety pivot pin 262. One end of the mainspring 252 is received in the groove 250 of the hammer 226 while the other end of the mainspring 252 is anchored to the peg 201. Another spring 203, which is denoted by its longitudinal axis and is a tension spring like the mainspring 252, has a first end anchored to the peg 201 and a second end passing through the hole 260*a* in the safety 260. The mainspring 252 urges the hammer 226 to its uncocked position whereas the spring 203 urges the safety 260 to its safe position.

Figure 16:
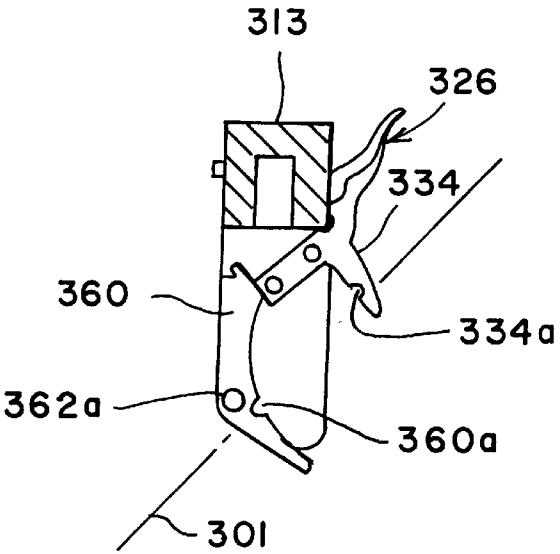
FIG. 16 is similar to FIG. 15 but shows an additional embodiment of an action.

Turning to FIG. 16, the same numerals as in FIG. 9, plus 300, indicate similar elements. The safety 360 is provided with a notch or groove 360*a* below the level of the bores 362*a* for the safety pivot pin 62. The cocking skirt 334 is likewise formed with a notch or groove 334*a*. A compression spring 301, which is denoted by its longitudinal axis and can be provided with internal plungers, is situated between the safety 360 and the cocking skirt 334. One end of the spring 301 engages the notch 360*a* in the safety 360 while the other end engages the notch 334*a* in the cocking skirt 334. The spring 301 biases the hammer 326 to its uncocked position and the safety 360 to its safe position.

Figure 17:
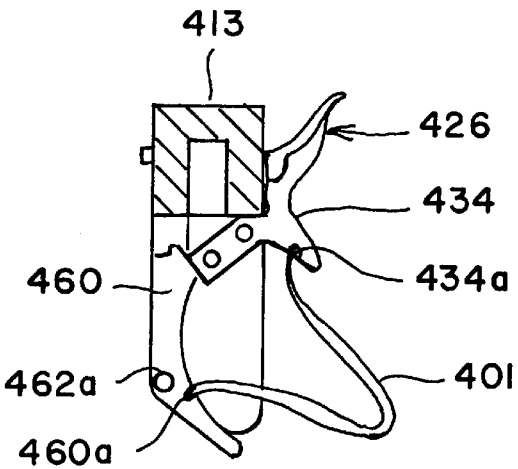
FIG. 17 is similar to FIG. 15 but illustrates a further embodiment of an action.

In FIG. 17, the same numerals as in FIG. 9, plus 400, identify corresponding elements. The structure of FIG. 17 is the same as that of FIG. 16 except that the compression spring 301 is replaced by a V-shaped spring 401.

Numerous biasing arrangements other than those illustrated in FIG. 15–17 can be employed for a firearm in accordance with the invention.

The invention is applicable to a wide variety of firearms other than the hunting pistol illustrated. Some examples of additional firearms in which the invention can be utilized are varminters, silhouette rifles, light mountain rifles and heavy benchresters.

Various modifications are possible within the meaning and range of equivalence of the appended claims.

I claim:

1. A firearm comprising:

a striking member movable between a fully cocked position and an uncocked position;

a safety movable between an inactive position and a blocking position in which said safety blocks said striking member from said uncocked position when said striking member is in said fully cocked position;

a biasing member arranged to move said safety into said blocking position in response to movement of said striking member from said uncocked position towards said fully cocked position;

a trigger movable between a rest position and a firing position, said trigger being arranged to move said safety from said blocking position towards said inactive position in response to movement of said trigger from said rest position towards said firing position; and a sear movable between an inoperative position and an intercepting position in which said sear engages said striking member to prevent movement of said striking member from said fully cocked position towards said uncocked position, said safety being arranged to move said sear from said intercepting position towards said inoperative position as said trigger moves said safety from said blocking position towards said inactive position.

2. The firearm of claim 1, wherein said striking member, safety, biasing member, trigger and sear are mounted for pivotal movement between the respective positions.

3. A firearm comprising:

a striking member movable between a fully cocked position and an uncocked position;

a safety movable between an inactive position and a blocking position in which said safety blocks said striking member from said uncocked position when said striking member is in said fully cocked position;

a biasing member arranged to move said safety into said blocking position in response to movement of said striking member from said uncocked position towards said fully cocked position; and a sear movable between an inoperative position and an intercepting position in which said sear engages said striking member to prevent movement of said striking member from said fully cocked position towards said uncocked position, said safety being arranged to move said sear from said intercepting position towards said inoperative position as said safety moves from said blocking position towards said inactive position, and said safety being arranged to move said sear into said intercepting position as said safety moves into said blocking position.

4. The firearm of claim 3, further comprising a trigger movable between a rest position and a firing position, said trigger being arranged to move said safety from said blocking position towards said inactive position in response to movement of said trigger from said rest position towards said firing position.

5. The firearm of claim 3, wherein said safety includes at least one pair of spaced legs defining at least one gap and a bridging element connecting said legs to one another, and said sear is located in register with said gap and has a part arranged to bear against said bridging element.

6. The firearm of claim 5, wherein said legs extend to one side of said bridging element, said safety including spaced second legs extending to another side of said bridging element and defining a second gap; and further comprising a resilient member which acts on said striking member and said biasing member, said biasing member being provided with means for adjusting the force of said resilient member, and said adjusting means being in register with said second gap.

7. The firearm of claim 6, wherein said biasing member has a pair of additional legs and each of said additional legs is arranged to bear against a respective second leg.

8. The firearm of claim 3, wherein said striking member is arranged to restrict movement of said sear in a direction away from said inoperative position when said striking member is in said uncocked position or in a position between said uncocked and fully cocked positions.

9. The firearm of claim 3, wherein said striking member has a partly cocked position and said biasing member is arranged to urge said safety from said inactive position towards said blocking position in response to movement of said striking member from said uncocked position to said partly cocked position.

10. The firearm of claim 9, wherein said striking member is arranged to engage said safety when said striking member is in said partly cocked position, said striking member being arranged to become disengaged from said safety in response to movement of said striking member from said partly cocked position to said fully cocked position.

11. The firearm of claim 10, wherein said striking member has first retaining means and said safety has second retaining means, said first and second retaining means cooperating in said partly cocked condition to prevent movement of said safety from said blocking position to said inactive position and to prevent movement of said striking member from said partly cocked position to said uncocked position.

12. The firearm of claim 11, wherein said first retaining means comprises a first projection on said striking member and said second retaining means comprises a second projection on said safety.

13. The firearm of claim 3, further comprising a resilient member which acts on said striking member and said biasing member, said resilient member urging said striking member towards said uncocked position and urging said biasing member against said safety.

14. The firearm of claim 13, wherein said biasing member is provided with means for adjusting the force of said resilient member.

15. The firearm of claim 14, wherein said adjusting means is provided with a groove and a part of said biasing member is received in said groove.

16. The firearm of claim 15, wherein said adjusting means comprises a screw.

17. The firearm of claim 3, wherein said striking member is arranged to hold said safety in said inactive position when said striking member is in said uncocked position.

* * * * *